United States Patent [19]

Scott

[11] 4,015,298

[45] Apr. 5, 1977

[54] TILTABLE HEADBOARD

[76] Inventor: Chester A. Scott, Ridgeview Drive, Burlington, Iowa 52601

[22] Filed: Feb. 2, 1976

[21] Appl. No.: 654,240

[52] U.S. Cl. ..... 5/327 B

[51] Int. Cl.[2] ..... A47C 21/00

[58] Field of Search ..... 5/324, 325, 327 B, 327 R, 5/317 R, 308, 53 R, 53 B, 53 C, 53 D; 312/348

[56] References Cited

UNITED STATES PATENTS

| | | | |
|---|---|---|---|
| 221,307 | 11/1879 | Hirsch | 312/348 UX |
| 1,156,125 | 10/1915 | Ahlborn | 5/327 B |
| 2,479,626 | 8/1949 | Klein | 312/348 |
| 2,691,175 | 10/1954 | Brahm et al. | 5/53 R |
| 2,724,127 | 11/1955 | Trivas et al. | 5/53 R |
| 2,844,829 | 7/1958 | Levy | 5/327 R |
| 3,753,557 | 8/1973 | Kelly | 5/327 R X |

FOREIGN PATENTS OR APPLICATIONS

| | | | |
|---|---|---|---|
| 462,839 | 3/1937 | United Kingdom | 5/327 B |
| 1,286,102 | 8/1972 | United Kingdom | 5/53 R |

*Primary Examiner*—Paul R. Gilliam
*Assistant Examiner*—A. M. Calvert
*Attorney, Agent, or Firm*—James C. Nemmers; Haven E. Simmons

[57] ABSTRACT

A tiltable headboard for beds which provides for comfortable and proper support of the head and upper body of a person who is in a reclining-seated position on the bed. The headboard swings out about a fixed upper pivot and has a telescoping lower section that extends and rests on the bed as the headboard is swung outwardly.

6 Claims, 4 Drawing Figures

TILTABLE HEADBOARD

BACKGROUND OF THE INVENTION

There are occasions when a person, while in bed, wishes to sit up to watch television, read, work, etc. Everyone has probably attempted to do this at one time or another and has found it quite difficult to remain in this reclining-seated position very long. In an attempt to make this reclining-seated position more comfortable, there have been developed tiltable or adjustable headboards for beds. If these are permanently affixed to the bed or to the wall behind the bed, it is generally desirable that the headboard be designed so as to be retracted flat when not in use, thereby permitting the use of the full area of the bed for sleeping.

There have been designed a number of different headboards which designs have attempted to provide a satisfactory reclining headboard that can be swung out of the way when not in use. One of the basic problems with such headboards is to provide a means for securing the headboard in a selected inclined position. The solution of this problem is not as simple as might appear since the lower edge of the headboard becomes further away from the surface of the bed as the headboard is swung outwardly. To permit the lower edge of the headboard to at all times rest on the bed as it is swung outwardly to a selected inclined position, various means have been suggested by the prior art. One such means is to provide a movable upper pivot which allows the entire headboard to move downwardly as the outer edge is swung outwardly. Obviously, this requires a somewhat complex mechanism. An example of this type of headboard is shown in Levy U.S. Pat. No. 3,217,341. Another suggested solution for this problem is to have a member pivotally mounted at the lower end of the headboard which can be swung outwardly to provide a "longer" headboard when it is in the inclined position. Such a headboard is shown in Trivas et al U.S. Pat. No. 2,724,127. However, this design permits only one selected inclined position, and because of the relatively high force exerted on the headboard when it is in its inclined position, this design may tend to wear out or break with repeated usage. Other designs suggested by the prior art involve variations of the foregoing two basic designs or provide a structure by which the upper portion of the bed itself can be pivoted upwardly to an inclined position. This particular design becomes very complex and expensive since the mattress on the bed must also be allowed to bend. A common example of this type of inclined bed is found in hospitals.

The prior art does not disclose a simple tiltable headboard for beds which allows the headboard to be positioned in any selected position but which will be sturdy and long-lasting. Also, many of the prior art designs do not include a headrest and may include a mechanism that interferes with upholstering or other aesthetic covering on the headboard. Usually, such mechanism interferes with the storage space behind the headboard when it is in an inclined position. It is, therefore, an object of the present invention to provide a headboard which overcomes the disadvantages of prior art designs as outlined above.

SUMMARY OF THE INVENTION

The headboard unit of the invention is an easily operated, adjustable-angle unit which swings out about an upper fixed pivot with a lower section that slides in and out of the upper section so that the lower edge of the lower section will be supported on the bed when the headboard is at any selected inclined angle. When the headboard is not being used to support a person in a reclining-seated position, the slidable lower portion will telescope back into the upper section as the unit is swung back against the headboard panel or wall upon which it is mounted. The unit may be held in this latter position by a suitable catch, and when in this position, it appears merely as a decorative headboard panel. The combination of the fixed upper pivot and the slidable lower section provides for an easily operated unit which can be set at any selected incline. The unit further includes a headrest, and because of its simple design, all mechanism behind the headboard is eliminated thus permitting this space to be fully used for storage while the unit is in an inclined position.

DESCRIPTION OF THE PREFERRED EMBODIMENT OF THE INVENTION

Figure 1:
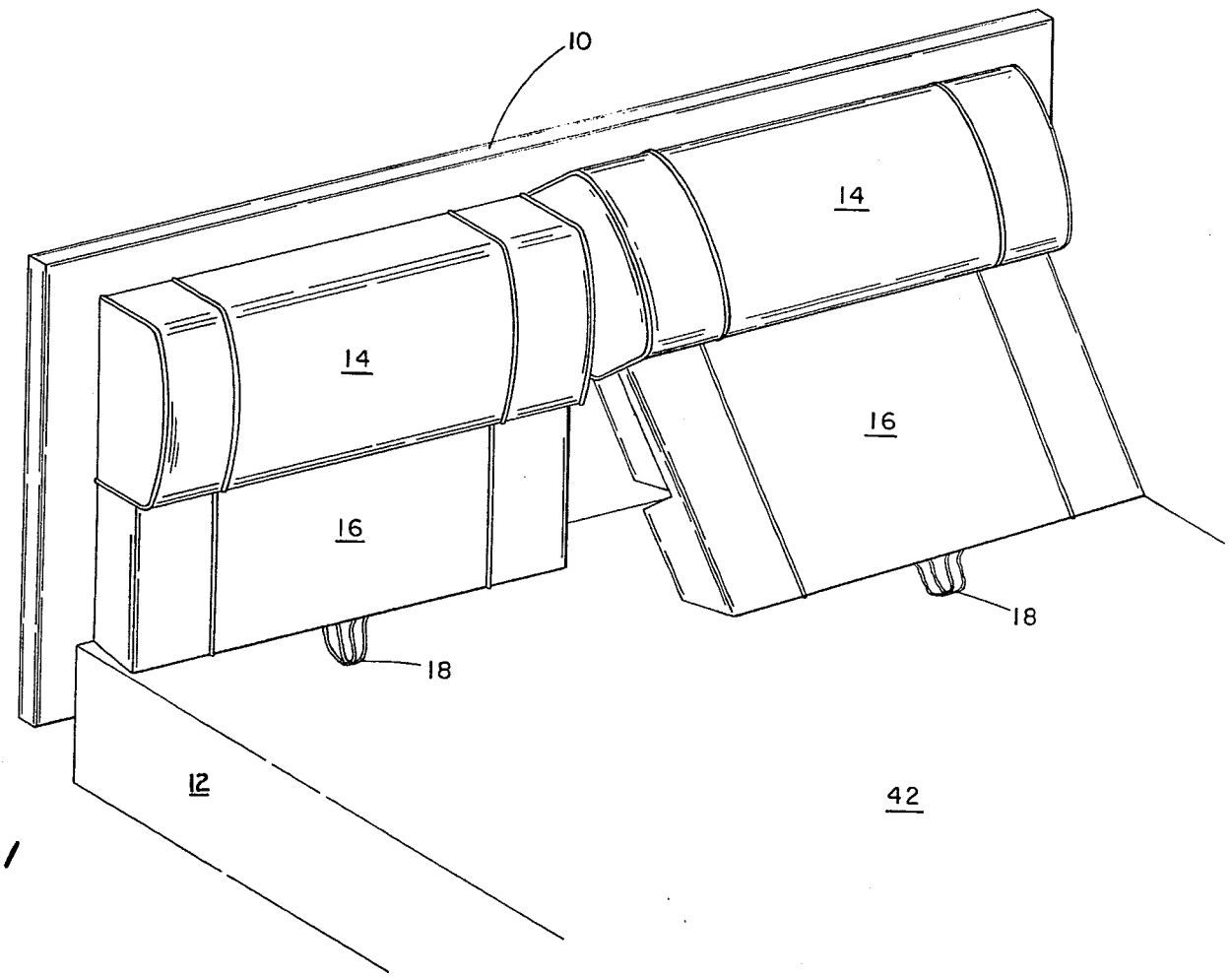
FIG. 1 is a perspective view of a double headboard unit showing one of the units in an inclined position.

In FIG. 1 there is shown a headboard for a double bed which headboard includes two separate independent units constructed according to the principles of the invention. FIG. 1 shows one of the headboard units in the normal position when not in use while the other headboard unit is shown in an inclined position. It should be understood that the headboard unit can be mounted on a headboard panel 10 which is suitably supported on the bed frame 12, or the headboard unit of the invention may be mounted directly on the wall against which the bed is positioned.

Each of the headboard units includes an upper section 14 and a lower section 16. The upper and lower sections 14 and 16 may be covered with upholstery or any suitable covering to provide an attractive and decorative appearing headboard. Such covering is indicated in FIG. 1 and is shown by dotted lines in FIG. 3, it being understood that suitable padding would preferably be provided on the upper section 14 so that this section can also serve as a headrest.

Figure 3:
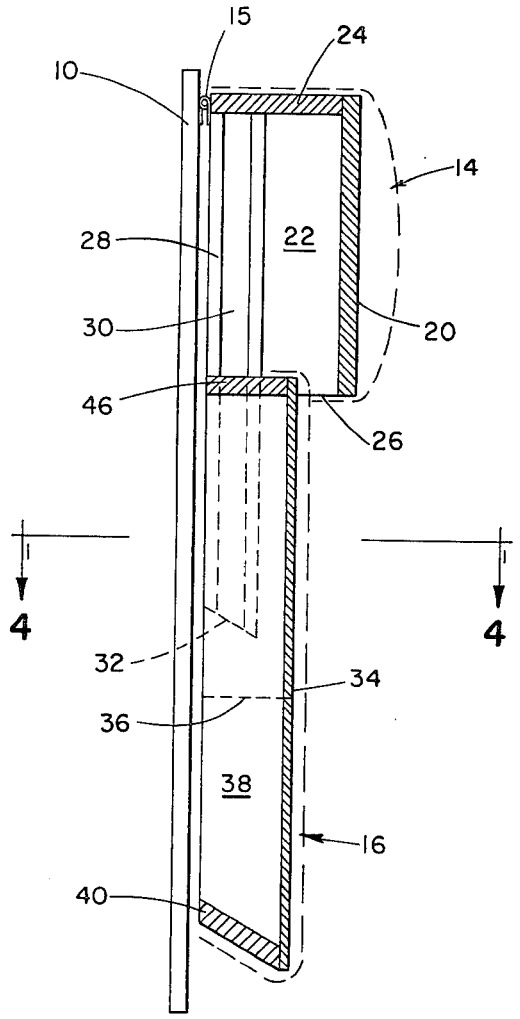
FIG. 3 is a sectional view taken on the line 3—3 of FIG. 2 and showing the unit upright but extended.
Figure 4:
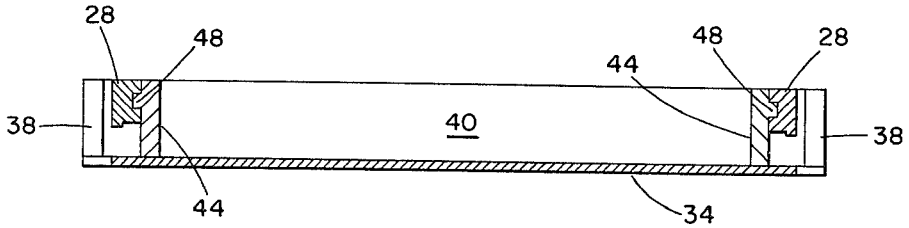
FIG. 4 is a sectional view taken on the line 4—4 of FIG. 3.

The upper section 14 is pivotally mounted at its upper edge on hinge 15 as shown in FIG. 3. The lower section 16 is slidable toward and away from the upper section 14 in a manner to be described more fully hereinafter. To permit the headboard unit to be swung outwardly to an inclined position, there may be provided a suitable loop of material or handle 18 affixed to the lower edge of the lower section 16. This is shown in FIG. 1.

The frame for the upper section 14 is of a box-like construction and therefore consists of a facing member 20 that provides the front support for the upper section 14. Facing member 20 has affixed to it at each side a side member 22 that extends rearwardly from the facing member 20. A top member 24 is affixed to the facing member 20 along its upper edge and also joins the side members 22 to form a box-like frame that is open at the rear and open along the lower edge. The side members 22 each terminate in a lower edge 26 that serves as a stop member when the unit is closed in the manner hereinafter described.

Affixed to the inside of each side member 22 and extending downwardly a distance below the lower edge 26 is a guide member 28 which includes a groove 30 extending along its entire length and which serves as a guiding track for the lower section 16 in the manner hereinafter described. The lower edge 32 of each guide member 28 is formed at an angle which angle is the same as the angle of the lower edge of the lower section 16 as described hereinafter.

The lower section 16 is also of a generally flat box-like construction, the depth from front to rear of which is preferably not as great as the depth of the upper section 14. This difference in depth permits the upper section 14 to serve as a headrest. The lower section 16 has a facing member 34 that provides the front surface of the lower section 16. This facing member 34 is wider along the lower portion thereby forming notches 36. Side members 38 are affixed to and extend rearwardly from the facing member 34 only to the lower portion thereof below notches 36. The bottom member 40 of the lower section 16 is affixed to the side member 38 and extends the full length of the lower section 16. The bottom member 40 is formed at an angle as best seen in FIG. 3 to facilitate engagement of the bottom member 40 on the upper surface 42 of the bed when the headboard unit is in an inclined position.

Figure 2:
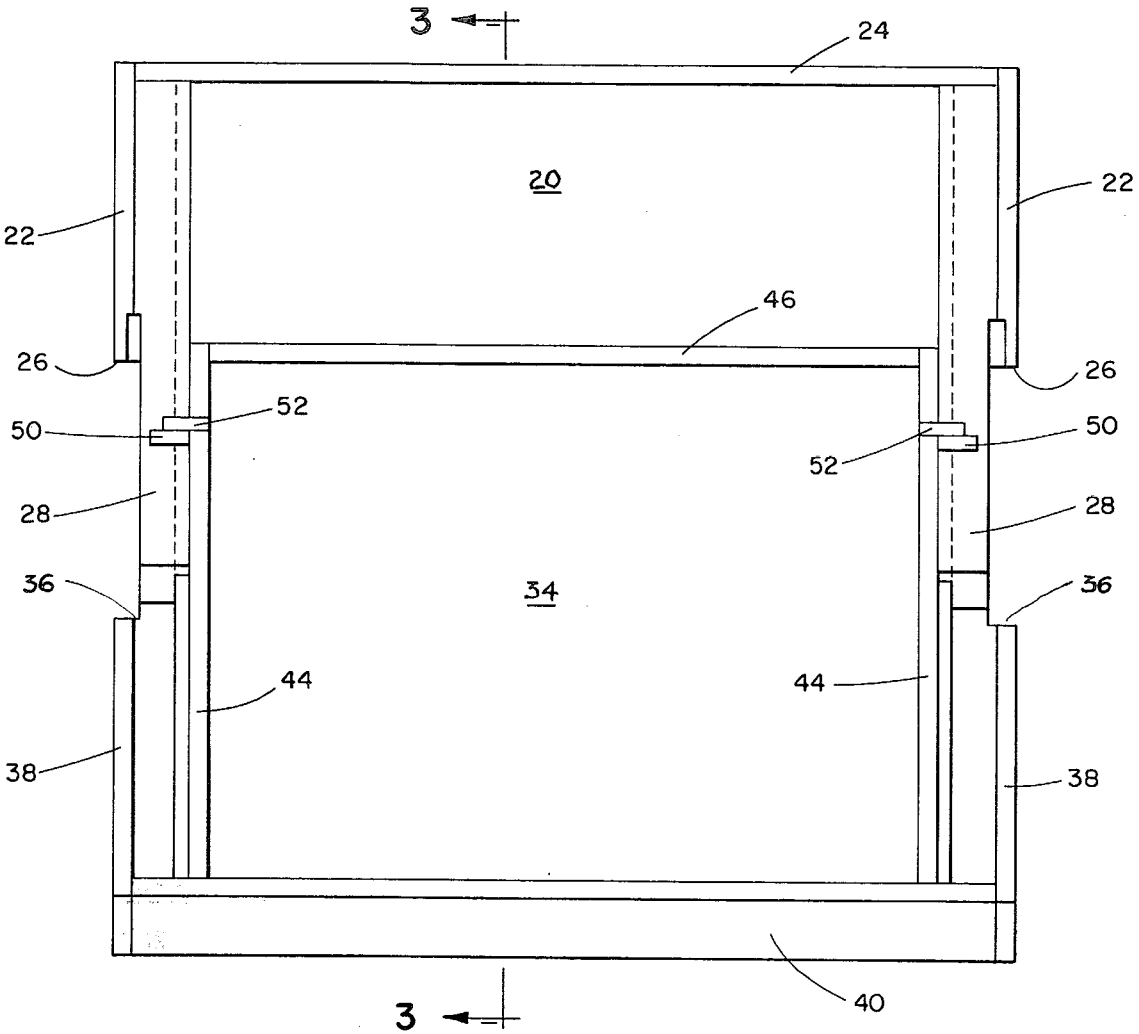
FIG. 2 is a rear elevational view of one of the units and showing the lower section in a fully extended position.

Guide supports 44 are spaced inwardly from side members 38 and extend upwardly from the bottom member 40 to the top edge of the facing member 34 where they are joined by a top member 46 which extends the full length of the facing member 34 along its top edge. Affixed to the outer side of each of the guide supports 44 is a guide 48 which is engageable in the groove 30 of the guide member 28 of the upper section 14. As best seen in FIG. 2, there is sufficient space between the guide supports 44 and the side members 38 to permit the guide members 28 of the upper section 14 to telescope inside of the lower section 16 when the unit is fully closed and in a fully upright position. Note that when the unit is fully closed, the upper edges of the side members 38 of the lower section 16 engage the lower edges 26 of the side members 22 of the upper section 14 thereby serving as stops or limiting members. When in this fully closed position, the unit has the appearance of a decorative and attractive headboard unit with no mechanism being exposed. Even when in the extended position, the unit has an attractive appearance with no mechanism exposed. In this regard, the space between the side members 38 of the lower section 16 is sufficient to permit a suitable decorative covering to be placed over the outside surfaces of the guide members 28 of the upper section 14 so that none of the frame members will be exposed even when the unit is in the fully extended position. Also, as best seen in FIG. 3, the facing member 34 of the lower section 16 is spaced rearwardly from the inside surface of the facing member 20 of the upper section 14 so that the entire front surface of facing member 34 may also be covered with a suitable decorative material. Thus, even when the unit is fully extended, none of the frame members will be exposed and thus the unit always presents an attractive appearance. Also, when the unit is extended and in an inclined position, there is no mechanism of any type necessary between the panel 10 (or wall as the case may be) and the rear surface of the headboard unit. This provides a space for storage of a pillow or other object while the unit is in use.

In order to prevent the lower section 16 from becoming disengaged from the upper section 14 when the unit is extended, there is preferably provided stop means to limit the extension of the lower section. As shown in FIG. 2, this stop means may be in the form of a stop plate 50 affixed to the rear of each guide member 28 of the upper section 14, which stop plates 50 are engageable with stop plates 52 affixed to the rear of the guide supports 44 of the lower section 16 when it is fully extended. As shown in FIG. 2, the stop plates 50 extend into the path traveled by the stop plates 52 as the lower section is extended. Of course, other suitable stop means may be used.

If desired, there also may be provided a catch (not shown) affixed to the rear of facing member 34 of the lower section 16 which catch 34 is engageable with a corresponding member (not shown) secured to panel 10 when the unit is fully closed. The catch serves to hold the lower section 16 in the closed position and also maintains the headboard unit against the panel 10. Obviously, the unit will generally be maintained in the closed position by the fact that the bottom member 40 rests on the upper surface 42 of the bed. However, a catch would assure that the unit is maintained in the closed position during times when the mattress is removed for cleaning, turning, etc.

The combination of the fixed upper pivot about which the entire unit swings with the slidably mounted lower section 16 provides a strong unit which will easily support a person in a natural reclining-seated position on the bed. Unlike some units of the prior art, movement of the mattress up and down as the user shifts position will not exert any excessive force on the unit since the lower section 16 will merely slide up and down as the bed moves without disturbing the angle of incline of the unit. This eliminates the possibility of breakage of the unit, and the sliding action further absorbs any excessive force which might otherwise be exerted on the pivot mounting at the upper end of the upper section 14.

Obviously, the unit can be made for a twin-sized bed, or duplicate units can be mounted on double beds of the standard, queen or king size by merely modifying the width of the units. Of course, the headboard units of the invention may be affixed to standard bed frames of wood, metal or any other material or they may be mounted on a special headboard panel or directly on the wall behind the bed. In addition, these units could be used on furniture other than beds. For example, the units could be used on upholstered chairs, sofas, and the like to provide an effect similar to the well-known recliners.

Although the invention has been described only in connection with the preferred embodiment thereof, it will be obvious to those skilled in the art that various revisions and modifications can be made to the preferred embodiment shown herein without departing from the spirit and scope of the invention. It is my intention, however, that all such revisions and modifications as are obvious to those skilled in the art will be included within the scope of the following claims.

I claim:

1. A tiltable suport unit for the upper body and head usable in connection with a generally horizontal supporting surface such as a bed or seat and the like, said tiltable support unit having a front surface engageable by the upper body and head and comprising: a generally hollow box-like upper section mountable on a stationary pivot above said horizontal supporting surface for swingable movement of said unit out over said horizontal supporting surface to a selected inclined position, a lower section attached to and swingable with said upper section, and guide means combined with said upper section and said lower section to provide for free telescopic movement of said lower section inside of said upper section and toward and away from said upper section thereby to vary the length of said unit as it is swung about said stationary pivot, the bottom of said lower section providing a flat surface inclined upwardly from the front surface of the unit toward the rear, said flat surface being engageable with said horizontal supporting surface when said unit is swung to a selected inclined position with said lower section extended whereby said unit is maintained in said selected inclined position, said upper section having a front, sides and a top and being open at the bottom, said guide means including a first guide member affixed to the inside of each side of said upper section, said lower section being of a generally box-like construction with a front, sides and bottom, and a second guide member of said guide means affixed to the inside of each side of said lower section and engageable with a respective one of said first guide members thereby providing for linear slidable movement of said lower section relative to said upper section.

2. A tiltable support unit for the upper body and head usable in connection with a generally horizontal supporting surface such as a bed or seat and the like, said tiltable support unit comprising: an upper section mountable on a stationary pivot above said horizontal supporting surface for swingable movement of said unit out over said horizontal supporting surface to a selected inclined position, said upper section being of a generally rectangular box-like construction and having a front, side, top and open at the bottom, a lower section attached to and swingable with said upper section, said lower section being of a generally rectangular box-like construction and having a front, side and a bottom, a first guide member affixed to the inside of each side of said upper section and extending downwardly beyond said upper section, a second guide member affixed to the inside of each side of said lower section and engageable with a respective one of said first guide members to provide for limited linear movement of said lower section toward and away from said upper section so as to vary the length of said unit as it is swung about said stationary pivot, the bottom of said lower section being engageable with said horizontal supporting surface when said unit is swung to a selected inclined position with said lower section extended whereby said unit is maintained in said selected inclined position.

3. The tiltable support unit of claim 2 in which the first and second guide members are of a tongue-and-groove-type construction and are engageable with each other over a substantial length even when said lower section is fully extended, said guide members thereby limiting movement of said lower section to slidable movement in generally one plane.

4. The tiltable support unit of claim 3 in which there is provided stop means to limit the extension of said lower section thereby preventing said lower section from becoming detached from upper section.

5. The tiltable support unit of claim 3 in which said upper section is generally hollow and the upper portion of said lower section telescopes inside of said upper section when said unit is closed.

6. The tiltable support unit of claim 5 in which the front to rear dimension of the lower section is sufficiently less than the inside front to rear dimension of said upper section thereby to provide for the application of a decorative covering over said sections.

* * * * *